US005651336A

United States Patent [19]

Rygiel et al.

[11] Patent Number: 5,651,336

[45] Date of Patent: Jul. 29, 1997

[54] VARIABLE VALVE TIMING AND LIFT MECHANISM

[75] Inventors: Ronald Rygiel, Prospect Heights, Ill.; Antoni Szatkowski, Windsor, Canada

[73] Assignee: Chrysler Corporation, Auburn Hills, Mich.

[21] Appl. No.: 715,283

[22] Filed: Sep. 16, 1996

Related U.S. Application Data

[63] Continuation of Ser. No. 578,758, Dec. 26, 1995.

[51] Int. Cl.[6] ..... F01L 13/00

[52] U.S. Cl. ..... 123/90.16; 123/90.39

[58] Field of Search ..... 123/90.15, 90.16, 123/90.17, 90.27, 90.39, 90.44

[56] References Cited

U.S. PATENT DOCUMENTS 4,887,563 12/1989 Ishida et al. ..... 123/90.16

5,207,193 5/1993 Sugimoto et al. ..... 123/90.16

5,553,584 9/1996 Konno ..... 123/90.16

5,590,627 1/1997 Rygiel et al. ..... 123/90.16

*Primary Examiner*—Weilun Lo

*Attorney, Agent, or Firm*—Kenneth H. MacLean

[57] ABSTRACT

A variable valve selection assembly for an engine valve train of an engine cylinder head which has dual camshafts and two valves associated with each camshaft per cylinder. The variable valve selection assembly includes two end rocker arms and a middle rocker arm and a selectively actuated latching mechanism operative between an end rocker arm and the middle rocker arm so as to selectively link an end rocker arm with said middle rocker arm whereby an end rocker arm moves independently of said middle rocker arm in some modes of operation and whereby an end rocker arm moves in common with said middle rocker arm in other modes of operation.

8 Claims, 3 Drawing Sheets

VARIABLE VALVE TIMING AND LIFT MECHANISM

RELATED APPLICATION

This application is a continuation of copending application Ser. No. 08/578,758, entitled "Variable Valve Timing and Lift Mechanism", filed Dec. 26, 1995 by the same inventors as the subject application.

TECHNICAL FIELD

For an internal combustion engine of the overhead camshaft type with two intake and/or exhaust valves per cylinder and a camshaft with three lobe portions per cylinder, a valve train mechanism including three rocker arms per cylinder and positioned in a side by side arrangement. Each rocker arm is activated by one of the three camshaft lobes with two rocker arms directly activating the intake valves and the other middle rocker arm normally moving independently of the other two. The mechanism includes latching means to selectively link the other rocker arms with the third middle rocker arm whenever an increased lift characteristic is desirable. Selective activation and deactivation of the latching means produces four different operational modes of the pair of intake/exhaust valves.

BACKGROUND OF THE INVENTION

A simple variable lift and/or timing valving arrangement for a twin intake (and/or exhaust) valved engine has long been desirable. At idle and relatively low loads, it is desirable to move the valves to a relatively low opened position (low lift) and for a relatively short duration for increasing the flow velocity of air entering a cylinder. This promotes a thorough mixing of air and fuel and provides a more complete combustion. At mid-level engine speeds with moderate loading, an increased opening (lift) of the valves and/or a longer opening duration is desirable to adequately meet the air and fuel needs of the engine. At greater engine speeds and/or greater loading of the engine, increased opening or lift of the valves and/or opening duration is desirable. At wide open throttle, it is desirable to increase again the opening of the valves and increase the opening duration to provide maximum power for the engine.

A preexamination patent search of the subject valve train arrangement uncovered U.S. Pat. Nos.: 4,727,830 to Nagahiro et. al.; 4,759,322 to Konno; 4,777,914 to Konno; 4,788,946 to Inoue et. al.; 4,793,296 to Inoue et. al.; 4,869,214 to Inoue et. al.; 4,887,563 to Ishida et. al.; 4,905,639 to Konno; and 5,031,583 to Konno which disclose valve train arrangements with modes of operation using three rocker arms arranged side by side and a camshaft with three lobes for each cylinder. The rocker arm located between two end rocker arms houses a pair of pistons within bores formed through each of its side surfaces which face the other rocker arms. A bore in the other rocker arms receives a piston which is selectively moveable out from the bore of the middle rocker arm. A pair of passages in the middle rocker arm selectively pressurize a space behind each of the pistons to cause movement of the piston. The U.S. Pat. No. 4,799,463 is similar to the above described patents except that four rocker arms are provided rather than three.

U.S. Pat. No. 4,768,475 to Ikemura discloses a valve train mechanism for a single intake valve type cylinder head utilizing a pair of rocker arms activated by a two lobed per cylinder camshaft. Multiple pins within aligned bores formed in one of the rocker arms and in an actuating arm are selectively moved to link the members together.

U.S. Pat. No. 5,033,420 to Matayoshi et. al. discloses a valve structure including pivots formed in the cylinder head and a hydraulic fluid supply passage to said pivot with an adjustment screw and passage therein.

U.S. Pat. No. 5,042,437 to Sakuragi discloses a valve train arrangement with a single rocker arm supporting several cam follower which are selectively retractable away from a respective cam lobe.

SUMMARY OF THE INVENTION

The subject variable valve timing, duration, and lift mechanism is for an internal combustion engine having an overhead camshaft and two intake valves per cylinder. The mechanism can also be useful for control of dual exhaust valves. The camshaft has three eccentric camshaft lobes for each cylinder of the engine. Three rocker arms are pivotally mounted at an end portion on a support shaft so as to be engaged by the cam lobes. The three rocker arms are arranged in side by side relationship to one another so that there are two end and one middle rocker arms. Each end rocker arm engages one of the intake valves. In a first mode of the valve train's operation, the two camshaft lobes directly engaging the two end rocker arms produce the lift, timing and opening duration operations of the valves contacted by the end rocker arms. The middle rocker arm does not effect valve actuation in this first mode.

A hydraulically powered latching mechanism is housed in each of the end rocker arms for selectively connecting an end rocker arm with the middle rocker arm. Preferably, a camshaft lobe which engages one end rocker arm has a profile which produces a relatively low lift and/or short opening duration valve actuation. Another camshaft lobe engages the other end rocker arm and preferably has a profile which produces a greater lift and/or longer opening duration valve actuation. Finally, the third camshaft lobe engages the middle rocker arm and preferably has a profile which produces a still greater lift and/or opening duration valve actuation.

The subject valve train includes hydraulically powered rocker arm latching mechanism to selectively lock an end rocker arm with the middle rocker arm so that the valve actuation through the end rocker arm is produced by the third cam lobe which engages the middle rocker arm. The mechanism consists of a movable latch or locking member which is normally housed within an end rocker arm. Specifically, the latching member has a cylindrical portion which is reciprocally mounted in the hollow interior of a shaft which also the supports the rocker arms. Another portion of the latching member forms a relatively thin, flat blade-like portion which extends radially away from the cylindrical portion and through a slot formed in the wall of the hollow support shaft. The blade portion extends into a pocket or cavity formed in an associated end rocker arm. The slot's width in a circumferential direction of the shaft is sufficient to allow pivotal movements of the associated rocker arm caused by actuation by a lobe of the camshaft and movement of the blade which extends through the slot. The middle rocker arm has a channel formed therein with a cross-sectional configuration conforming to the cross-section of the blade as well as the cross-section of the pockets in the end rocker arms. The slot's length in the axial direction of the shaft permits movements of the latch member from one position where the blade is wholly within the pocket of an end rocker arm to a second position where the blade is partly in a pocket and partly in a portion of the adjacent channel formed in the middle rocker arm.

Resultantly, the latching member can be moved from its normal rest position into an active position partly in an adjacent middle rocker arm. Various combinations of positioning the latching members relative to the middle rocker arm provides four modes of operation.

The movement of each of the latching members and the resultant operational modes of the valve train mechanism as described above are controlled by selective application(s) of hydraulic fluid pressure against outer end(s) of the cylindrical portion of the latching member(s). When no pressure is exerted on the outer ends, the latching members are in a rest position established by a spring. Specifically, opposite ends of a light coil spring engage inner ends of the two cylindrical portions to maintain the latching members within their respective end rocker arm pockets. When pressurized hydraulic fluid such as lubricating oil is applied to the outer end of a cylindrical portion, the resultant force thereon causes the latching member to be urged towards the middle rocker arm. When the pocket of the end rocker arm pivots relative to the channel of the middle rocker arm, the blade of the latching member will enter the channel. This locks the two rocker arms together for common pivotal actuation produced by the higher lift cam profile associated with the middle rocker arm. Withdrawal of the pressurized oil allows the pressure to fall due to leakage and consequently the blade exists the channel and retreats to the pocket of an end rocker arm.

The selective application of hydraulic pressure is under control of a central processing unit or computer which receives input in the form of engine related parameters, such as engine speed and temperature, and selects a proper application of pressurized fluid to cause the latching mechanisms to be active or inactive for operation of the associated valves.

DESCRIPTION OF EMBODIMENT SHOWN IN THE DRAWINGS

Figure 1:
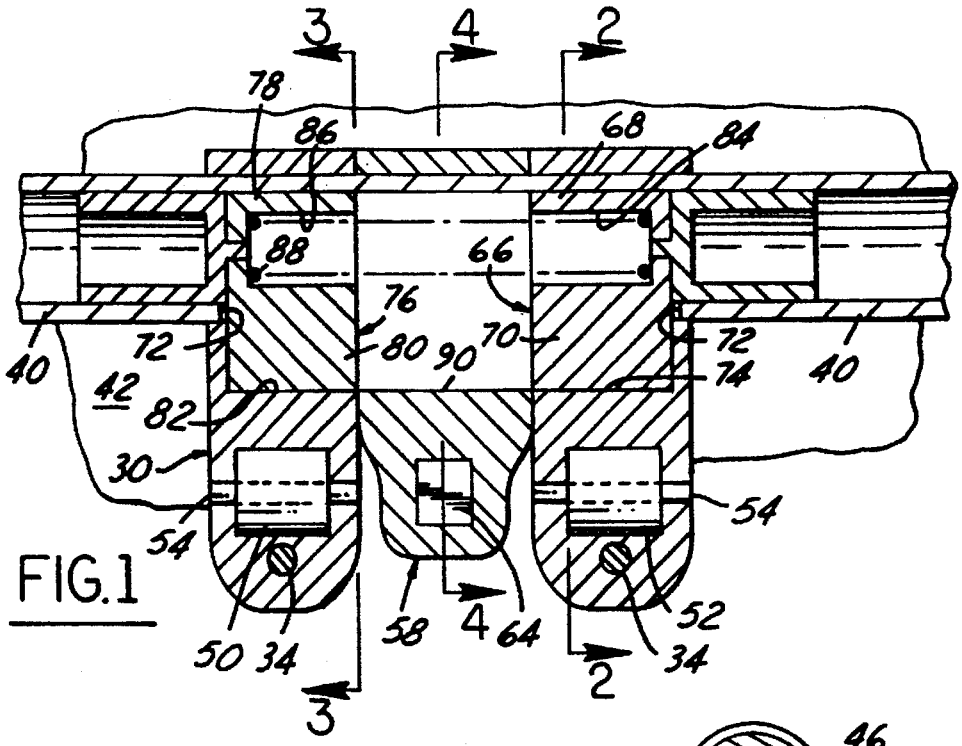
FIG. 1 is a top planar sectional view of a portion of a valve train associated with a single cylinder of a dual intake valve engine and in a first mode of operation.
Figure 2:
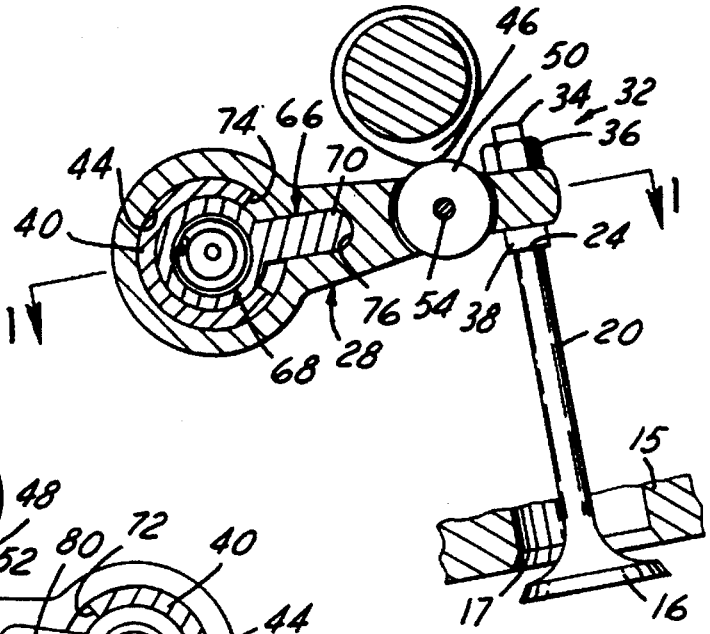
FIG. 2 is a side elevational and sectioned view of the valve train taken along section line 2—2 in FIG. 1 and looking in the direction of the arrows.

Turning now to FIGS. 1 and 2, shown is a portion of an engine valve train for a single cylinder of a dual intake valve type cylinder. One of the two intake valves 10 is visible in FIG. 2 and the other of the two intake valves 12 is visible in FIG. 3. Both valves are of the poppet type commonly used in internal combustion engines. Specifically, the valves 10, 14 each has an enlarged head portions 16, 18 respectively. The head portions are adapted to seat with a valve seat of the associated cylinder head (not shown) when in a closed operative position. The valves 10, 12 each has an elongated stem portion 20, 22 respectively. The stem portions 20, 22 each terminate at an upper end 24, 26 respectively.

The upper ends 24, 26 of valves 10, 14 are engaged by portions of respective rocker arms 28, 30. More specifically, each rocker arm carries an adjustable valve lash mechanism 32. The mechanism 32 includes a threaded shaft 34 and a locking nut 36 which coact to position a head portion 38 of shaft 34 against the upper ends of the valves. This type of lash adjustment mechanism is relatively common in engine design when it is desirable to selectively set a predetermined clearance between the position of the rocker arm and the end of the valve. Such a spacing is desired to accommodate thermal growth of the components as the engine achieves a working temperature. In particular, the elongated valves 10, 14 are subject to significant thermal growth.

Figure 3:
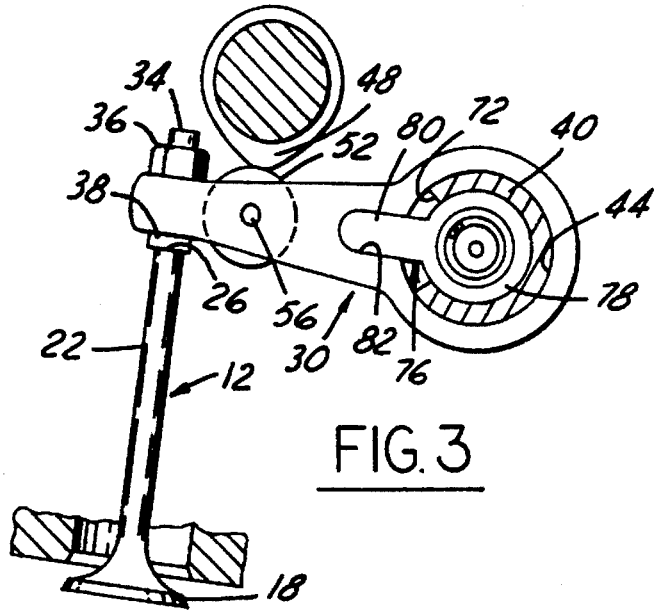
FIG. 3 is a view like FIG. 2 but taken along section line 3—3 in FIG. 1.

Referring again to FIG. 1, a hollow support shaft 40 extends parallel to the top surface 42 of a cylinder head. The support shaft 40 extends through cylindrical bores 44 in the rocker arms 28, 30 as best shown in FIGS. 2 and 3. The bores 44 permit the rocker arms to rotate or pivot about the support shaft 40. Clockwise pivotal motion of the rocker arms 28 in FIG. 2 and counterclockwise pivotal motion of the rocker arm 30 in FIG. 3 is caused by the action of camshaft lobes 46 and 48, respectively, against roller followers 50, 52 carried by the rocker arms as shown in FIGS. 2 and 3. Specifically, the roller followers 50 and 52 are supported on shafts 54, 56. As will be explained further hereinafter, the camshafts lobes 46, 48 are not of equal eccentricity. Specifically, the lobe portion 46 adapted to cooperate with rocker arm 28 is less severe than the lobe portion 48 which is adapted to cooperate with rocker arm 30.

It should be noted that a force tending to move rocker arm 28 in a counterclockwise direction in FIG. 2 and a force tending to move the rocker arm 30 in a clockwise direction in FIG. 3 are produced by valve springs (not shown). These valve springs are commonly used to close poppet type valves in an internal combustion engine and are usually positioned about the stem portions 20, 22.

As so far described, the engine valve train is capable of operating valves 10, 12 when rotation of the camshaft causes lobes 46, 48 to move over the roller followers 50, 52. This represents a first mode of valve train operation in which valve 10 is opened to a predetermined low lift or opening and valve 12 is opened to a predetermined higher lift or opening.

Figure 4:
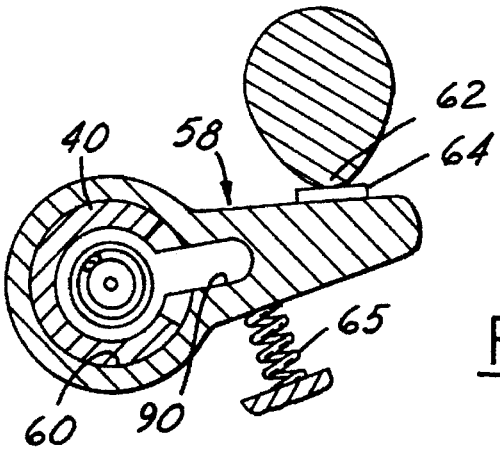
FIG. 4 is a view like FIG. 2 but taken along section line 4—4 in FIG. 1.

As previously noted, this valve train is configured to selectively provide three additional modes of operation. Referring back to FIG. 1, a third rocker arm 58 is supported by shaft 40 in between the other two rocker arms 28, 30. Like rocker arms 28 and 30, the third rocker arm 58 has a cylindrical bore 60 which is adapted to encircle shaft 40. Unlike the other rocker arms, it does not contact an intake valve. As shown in FIG. 4, a camshaft lobe 62 engages the rocker arm 58 which tending to rotate or pivot the arm in a clockwise direction. Specifically, the lobe 62 engages a wear pad 64 mounted upon the arm 58. The wear pad 64 is of hardened material so as to provide long life. Also, a spring 65 (shown somewhat schematically) yieldably urges the rocker arm 58 in a counterclockwise direction in FIG. 4 against the effect of cam lobe 62.

Referring again to FIGS. 1 and 2, a locking or latching member 66 includes a cylindrical portion 68 within the interior of support shaft 40. A thin, flat bar portion 70 extends radially from portion 68 through an elongated slot 72 formed in shaft 40. The bar portion 70 extends into a similarly configured pocket 74 formed within rocker arm 28. As seen in FIG. 2, the slot 72 is wide enough in the circumferential direction to allow the latching member to pivot with the rocker arm 28 and without interference with shaft 40.

Referring now to FIGS. 1 and 3, a locking or latching member 76 includes a cylindrical portion 78 within the interior of support shaft 40. A thin, flat bar portion 80 extends radially from the cylindrical portion 78 through the elongated slot 72 formed in shaft 40. The bar portion 80 extends into a similarly configured pocket 82 formed within the rocker arm 30. As best seen in FIG. 3, the slot 72 is wide enough in the circumferential direction to allow the latching member to pivot with the rocker arm 28 and without interference with shaft 40.

THE FOUR OPERATIONAL MODES

First Operational Mode

Referring to FIG. 1, cylindrical portion 68 of latching member 66 has a counterbore 84 formed therein. Likewise, cylindrical portion 78 of latching member 76 has a counterbore 86 formed therein. Opposite ends of an elongated coil spring 88 seat in respective counterbores 84, 86 to produce a yieldably force urging the latching members 66 and 78 away from one another and into pockets 74 and 82 of rocker arms 66, 76. In this position, the engagement of cam lobes 46, 48 with a respective rocker arm 28, 30 directly activates a respective valve 10 and 12.

Second Operational Mode

A channel 90 that has the same cross-sectional configuration of the pockets 76 and 82 is formed in the third or middle rocker arm 58. As seen from FIG. 1, in a common position of the three rocker arms, the pockets 76, 82 are aligned with the channel 90. In this position, either or both of the latching members 66, 78 are able to move partially out of their respective pockets and into the channel. When a latching member is within the channel 90, the action of the cam lobe 62 associated with the middle arm 58 controls the pivoting of that rocker arm.

Figure 5:
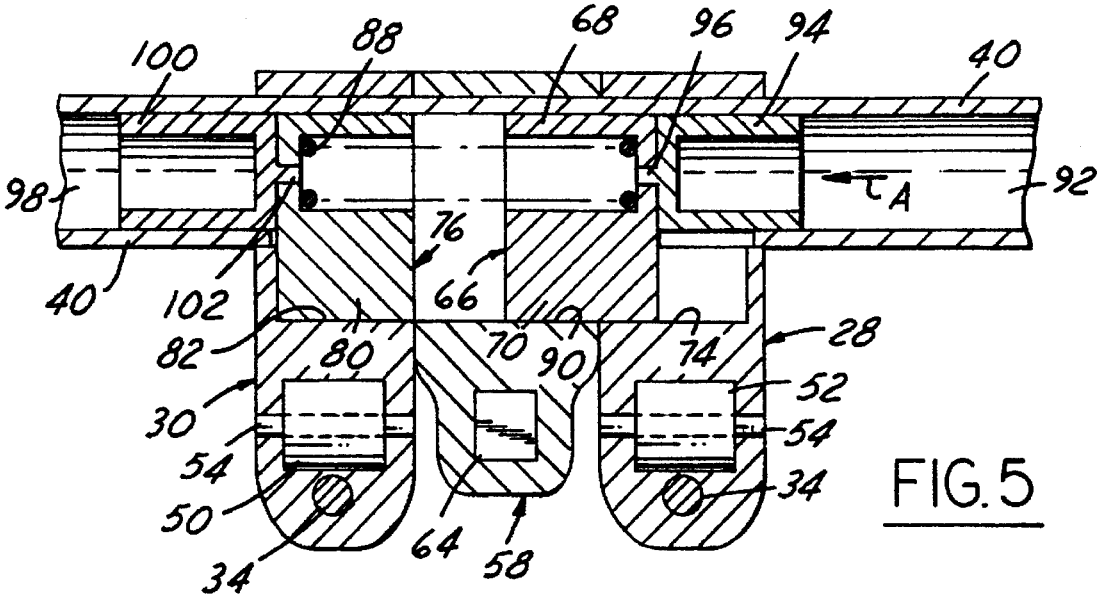
FIG. 5 is a view like FIG. 1 but in a second mode of operation.

The latching member 66 is moved to the left against the force of spring 88 to the position shown in FIG. 5 in response to a Force A. This force is selectively produced by routing pressurized fluid such as lubricating oil to the interior 92 of hollow shaft 40. A cup shaped piston 94 is attached by tab 96 to the cylindrical portion 68 of member 66 to direct the leftward movement of the member 66. Bar portion is then within both the pocket 74 and channel 90 which locks the arms 28 and 58 together for common pivotal movements.

Third Operational Mode

Figure 6:
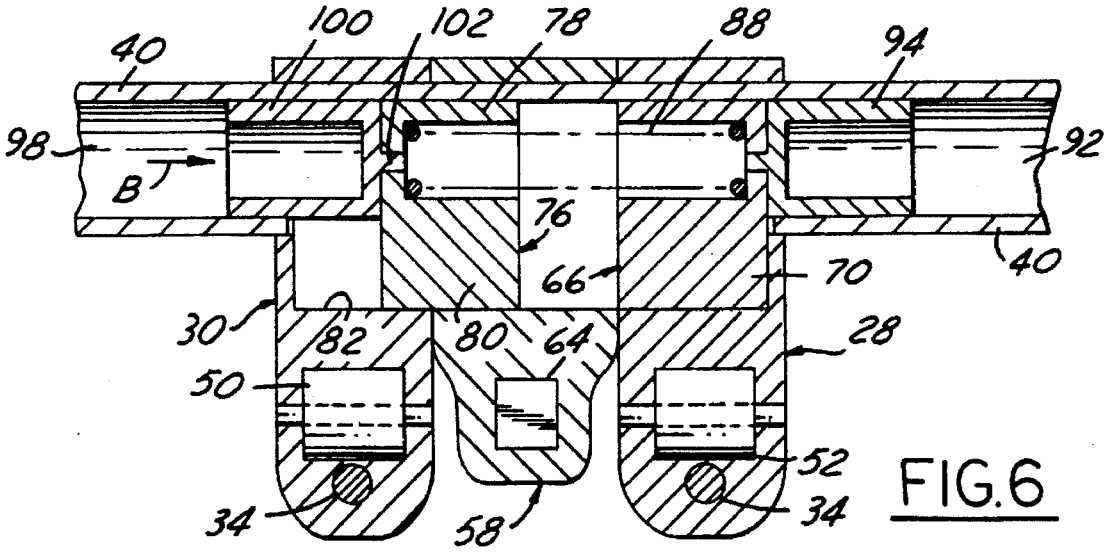
FIG. 6 is a view like FIG. 1 but in a third mode of operation.

Like the movement of member 66, latching member 76 is moved to the right in FIG. 1 against the force of spring 88 to the position shown in FIG. 6 in response to a Force B. This Force B is selectively produced by routing pressurized fluid such as lubricating oil to the interior 98 of hollow shaft 40. A cup shaped piston 100 is attached by tab 102 to the cylindrical portion 78 of member 76 to direct the rightward movement of the member 76. Bar portion 80 is then within both the pocket 82 and channel 90 which locks the arms 30 and 58 together for common pivotal movements.

Fourth Operational Mode

Figure 7:
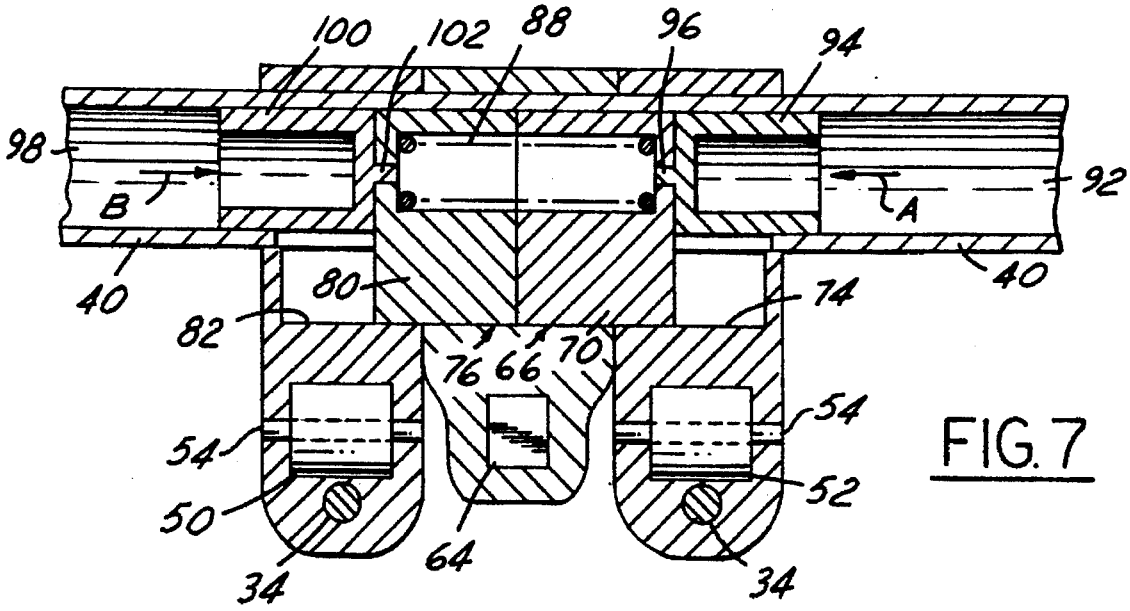
FIG. 7 is a view like FIG. 1 but in a forth mode of operation.

By simultaneously pressurizing both interiors 92 and 98 of shaft 40, the latching member 66 is moved to the left and latching member 76 is moved to the right from respective rest positions shown in FIG. 1 to latching positions shown in FIG. 7. In this mode, the bars 70 and 80 are both within their pockets 74, 82 and within the channel 90. Thus, the rocker arms 28 and 30 are both locked into movement with the rocker arm 58. Because the degree of eccentricity of the cam lobe 62 is greater than lobes 46 or 48, that lobe controls the lift and timing effects on the valves 10 and 12.

Figure 8:
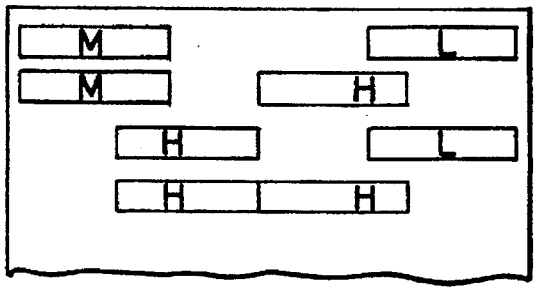
FIG. 8 is a somewhat schematic view showing placements parts of the valve train in four modes of operation.

The four modes of operation are best shown in FIG. 8 which indicates the position of the bars relative to the channel in the middle rocker arm. In a first mode, the low lift cam lobe directly controls valve 10 and the medium lift cam lobe directly controls valve 12. In a second mode, the low lift cam lobe directly controls valve 10 and the high lift cam lobe associated with the middle rocker arm indirectly controls valve 12 via the latching mechanism. In a third mode, the high lift cam lobe associated with the middle rocker arm indirectly controls valve 10 and the medium lift cam lobe directly controls valve 12. In a forth mode, the high lift cam lobe associated with the middle rocker arm indirectly controls both valves 10 and 12 via the latching mechanism.

While a preferred embodiment and methodology of the invention has been shown and described, other embodiments will now become apparent to those skilled in the art. Accordingly, this invention is not to be limited to that which is shown and described but by the following claims.

We claim:

1. A variable valve timing and lift mechanism for an internal combustion engine of the type with an overhead camshaft type cylinder head having two intake/exhaust valves per cylinder, comprising: a camshaft supported by the cylinder head and having three eccentric lobe portions associated with each engine cylinder; a tubular shaft supported by the cylinder head and extending substantially parallel to said camshaft; three rocker arm members associated with each cylinder and each rocker arm having an aperture formed therethrough for receiving said support shaft; said rocker arms being positioned on said support shaft in a side by side relation to one another therefore defining two end rocker arms and one middle rocker arm; each rocker arm being engaged by one of said eccentric cam lobes and capable of independent pivotal movement about said support shaft; each of the end rocker arms being directly connected to one valve; each end rocker arm having a cavity which defines a pocket therein; said middle rocker arm having a channel formed therein; a latching means associated with each of the end rocker arms and normally residing in the associated pocket so as not to contact said middle rocker arm; each of said latching means having a cylindrical portion housed within the interior of said tubular support shaft and with an integral blade portion; said support shaft having an elongated slot formed therein through which said blade portions extend into said pockets and said channel, wherein each of said latching means selectively moves partially out from said pocket and into said channel to thereby lock one of the end rocker arms and the middle rocker arm together for common pivotal movement together under the control of the camshaft lobe associated with said middle rocker arm.

2. The mechanism as set forth in claim 1 in which each of said blade portions has a generally thin, flat cross-sectional configuration, and the cross-sectional configuration of said associated pocket and said channel allows each of the blade portions to move in said associated pocket and said channel.

3. The mechanism as set forth in claim 1 in which each of said cylindrical portions has an axially facing outer end surface and and axially facing inner end surface; yieldable spring means engaging said inner end surface to bias said cylindrical portion into a normal rest position so that its associated blade portion resides within said associated pocket and not in said adjacent channel thereby permitting said end rocker arm to pivot independently of said middle rocker arm.

4. The mechanism as set forth in claim 3 in which said outer end surface of each of said cylindrical portions is selectively exposed to pressurized fluid so as to produce a force upon said cylindrical portion thereby causing said latching means and particularly said blade portion associated with said cylindrical portion to move partially out from said associated pocket and into said channel thereby linking said associated end rocker arm and said middle rocker arm together for common pivotal movement together under the control of the camshaft lobe associated with said middle rocker arm.

5. For a dual camshaft type cylinder head of an internal combustion engine having two valves associated with each camshaft per cylinder, the camshaft having three eccentric lobe portions per cylinder each with different lifts and profiles, a tubular support shaft paralleling the camshaft, a variable valve mechanism for producing four different modes of valve operation, the improvement comprising: three rocker arms mounted for pivotal movement on the support shaft for each cylinder and positioned in side by side relationship to form two end rocker arms and a middle rocker arm; each rocker arm being engaged by one of the three eccentric camshaft lobes; each of said end rocker arms engaging one of the two valves for directly operating its respective valve; each of the end rocker arms defining a pocket therein which has an open end portion abutting said middle rocker arm; said middle rocker arm defining a channel therein with open end portions abutting both of said end rocker arms; a latching means associated with each of said end rocker arms having a cylindrical portion housed within the interior of said tubular support shaft and with an integral blade portion; said support shaft having an elongated slot formed therein through which said blade portions extend into said pockets and said channel; said blade portion of said latching mechanism normally closely residing in one of said pockets; said pockets and said channel having a cross-sectional configuration conforming with the cross-sectional configuration of said blade portions so that the blade portions are capable of selective movement partially out of said pockets and into said channel for locking said end rocker arms and said middle rocker arm together for common pivotal movement.

6. The mechanism as set forth in claim 5 in which each of said blade portions has a generally thin, flat cross-sectional configuration, and the cross-sectional configuration of said associated pocket and said channel is similarly configured to allow the blade portion to move within said pocket and said channel.

7. The mechanism as set forth in claim 5 in which each of said cylindrical portions has an axially facing outer end surface and an axially facing inner end surface; yieldable spring means engaging said inner end surfaces to bias said cylindrical portions into a normal rest position in which said associated blade portion is maintained within said associated pocket and out of engagement with said middle rocker arm wherein said end rocker arms pivot independently of said middle rocker arm.

8. The mechanism as set forth in claim 7 in which said outer end surface of each of said cylindrical portions is selectively exposed to pressurized fluid so as to produce a force upon said associated cylindrical portion to cause it to move said blade portion associated with said cylindrical portion partially out of said pocket and into said channel thereby linking said associated end rocker arm and said middle rocker arm together for common pivotal movement together under the control of the camshaft lobe associated with said middle rocker arm.

* * * * *